US005586567A

United States Patent [19]

Smith et al.

[11] Patent Number: 5,586,567

[45] Date of Patent: Dec. 24, 1996

[54] DISHWASHER WITH TURBIDITY SENSING MECHANISM

[75] Inventors: John M. Smith; David A. Schneider, both of Louisville, Ky.; Mark E. Dausch, Latham; Walter Whipple, III, Amsterdam, both of N.Y.

[73] Assignee: General Electric Company, Louisville, Ky.

[21] Appl. No.: 370,795

[22] Filed: Jan. 10, 1995

[51] Int. Cl.[6] ..... A47L 15/46

[52] U.S. Cl. ..... 134/57 D; 68/12.02; 68/12.27; 134/113; 356/442

[58] Field of Search ..... 134/57 D, 113; 68/12.02, 12.27; 356/339, 442

[56] References Cited

U.S. PATENT DOCUMENTS

| | | | |
|---|---|---|---|
| 3,713,743 | 1/1973 | Simms | 356/442 X |
| 3,800,147 | 3/1974 | Shea et al. | 356/442 X |
| 3,861,802 | 1/1975 | Belmear, Jr. | 356/442 |
| 3,870,417 | 3/1975 | Bashark | 356/206 |
| 3,888,269 | 6/1975 | Bashark | 134/57 D |
| 4,222,250 | 9/1980 | Torita | 68/12 R |
| 4,637,719 | 1/1987 | Herman | 356/442 X |
| 5,172,572 | 12/1992 | Ono | 68/12.02 |
| 5,265,446 | 11/1993 | Kuroda et al. | 68/12.02 |
| 5,291,626 | 3/1994 | Molnar et al. | 8/158 |

FOREIGN PATENT DOCUMENTS

| | | | |
|---|---|---|---|
| 215736 | 8/1992 | Japan | 134/57 D |

*Primary Examiner*—Philip R. Coe
*Attorney, Agent, or Firm*—H. Neil Houser

[57] ABSTRACT

A turbidity sensing mechanism for a dishwasher is connected in the fluid circulation conduit between the pump and the spray mechanism. The mechanism includes a hollow housing enclosing a hollow transparent tube connected in fluid flow relationship with the conduit. A source of electromagnetic radiation and a radiation-to-frequency sensor are positioned inside the housing on opposite sides of the tube.

10 Claims, 3 Drawing Sheets

DISHWASHER WITH TURBIDITY SENSING MECHANISM

CROSS REFERENCE TO RELATED APPLICATIONS

This application is related to co-pending application Ser. No. 08/370,752 filed 01/10/95, entitled "A System And Method For Adjusting The Operation Cycle Of A Cleaning Appliance", by Dausch et al.

BACKGROUND OF THE INVENTION

This invention relates to a cleaning appliance and, more particularly, to a dishwasher including a sensing mechanism for determining the turbidity of fresh fluid added to the appliance and of the fluid at the conclusion of various operating cycles of the appliance.

There is significant need to reduce the energy consumed by appliances such as domestic dishwashers. More specifically, water used in such dishwashers is heated prior to its introduction into the machine and many such appliances include auxiliary heaters that further heat the fluid in the machine during a washing sequence. Thus it is desirable to minimize the number of separate operating cycles performed in a complete washing sequence. In the past such dishwashers have provided the user with the ability to choose between sequences including different predetermined numbers of operating cycles, often based upon whether the machine was to wash a load of dishes and tableware, a load of cooking utensils or a mixed load of items. Also many past machines permitted the user to select between different washing sequences based upon the user's estimate of how soiled the items were. If the user guessed incorrectly either the items were not sufficiently cleaned or the machine performed too many operating cycles, with an attendant waste of water and heat energy. Typically, users choose an operation sequence which would assure that the items were cleaned, which meant that many sequences included too many cycles and wasted water and energy.

More recently dishwashers have been designed which included devices for measuring the turbidity of the fluid in the dishwasher and controlled the number and length of the operating cycles based upon the condition of the fluid. One such system is shown and described in co-pending application Ser. No. 08/370,752 filed Jan. 10, 1995, herein incorporated by reference. The turbidity sensing mechanisms incorporated in many such machine designs attempt to measure the turbidity of the fluid when it is in a dynamic state. Such measurements are difficult to obtain and tend to be unreliable for a number of reasons. For example, the fluid in a dynamic state will tend to have bubbles entrained, which distorts the turbidity measurements. Furthermore turbidity sensing mechanisms are subject to measurement error due to many factors such as light source dimming or component performance degradation with age.

It is desirable to provide a dishwasher with a turbidity sensing system and mechanism that senses the turbidity of the fluid when the fluid is quiescent and provides compensation for factors that cause measurement errors with a sensing system. It also is desirable to provide a dishwasher with a sensing mechanism that is simple and economical to produce.

SUMMARY OF THE INVENTION

In accordance with one aspect of the invention The turbidity sensing mechanism includes an elongated housing mounted in the conduit circulating fluid from the machine's pump to a spray device. An elongated, transparent tube is positioned in the housing in fluid flow relationship with the conduit. A source of electromagnetic radiation, such as light, and an electromagnetic radiation sensor are positioned in the housing on opposite sides of the tube. The sensor responds to the radiation propagated through the fluid in the tube and generates a frequency signal representative of the turbidity of the fluid.

BRIEF DESCRIPTION OF THE DRAWINGS

The subject matter of the invention is particularly pointed out and distinctly claimed in the concluding portion of this specification. The invention, however, both as to organization and method of operation, together with further objects and advantages thereof, may best be understood by reference to the following detailed description, read in conjunction with the accompanying drawings in which:

DETAILED DESCRIPTION OF THE INVENTION

Figure 1:
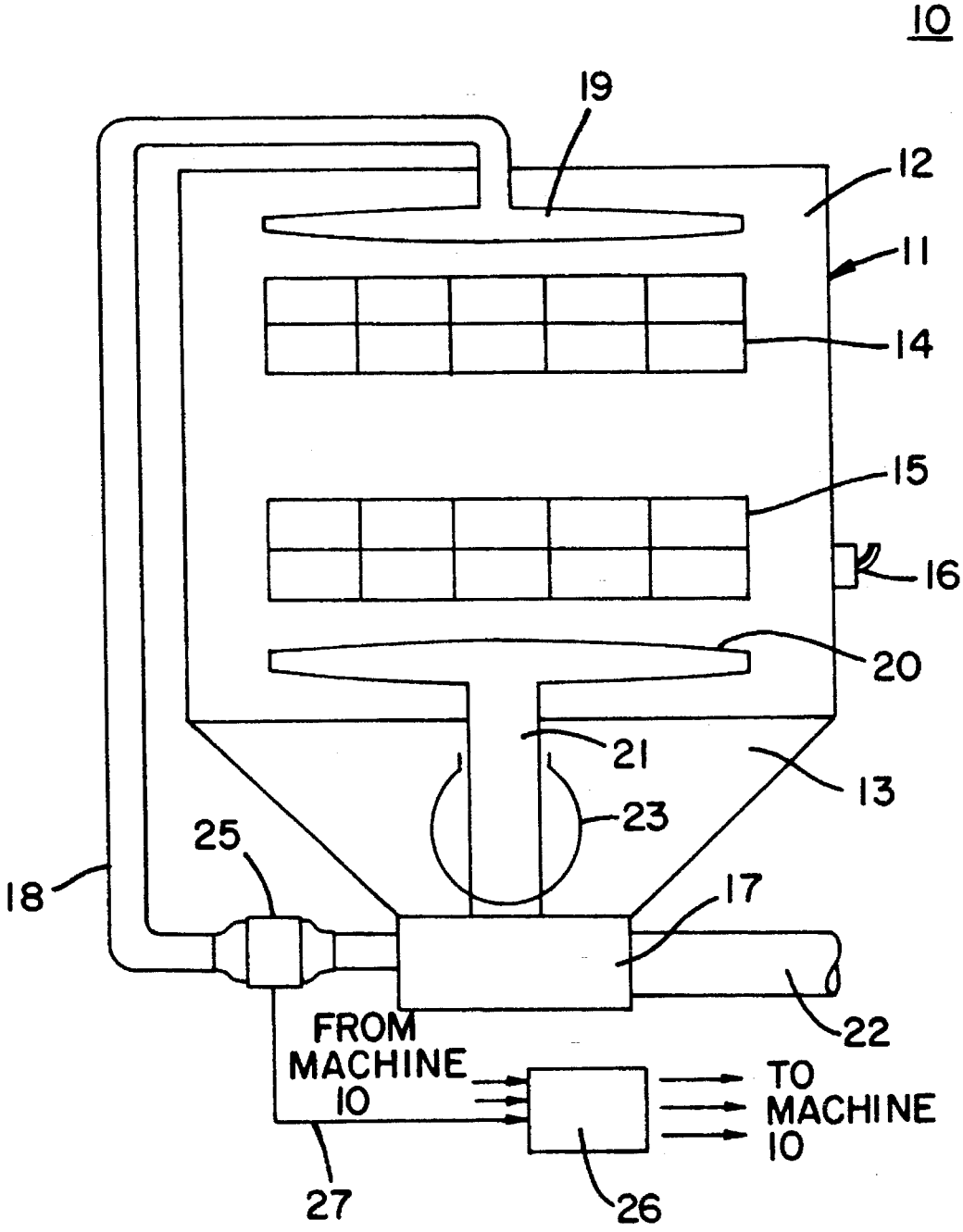
FIG. 1 a schematic diagram of a dishwasher incorporating one form of the present invention.

Referring now to FIG. 1, there is shown a dishwasher 10 including a housing 11 defining a chamber 12 to receive articles to be washed and a sump 13 at the lower end of the chamber. An upper rack 14 and a lower rack 15 are positioned in the chamber 12 to support items to be washed. Conveniently the racks 14,15 are mounted on moveable support mechanisms, not shown, to move into and out of the chamber for loading and unloading items to be washed. A water supply mechanism 16 connects the dishwasher 10 to a water supply, normally the household hot water supply.

The water in the chamber collects in the sump 13. A pump mechanism 17 is mounted below the sump and has an inlet connected to the sump to receive water from the sump. The pump mechanism has an outlet connected to a conduit 18, the other end of which is connected to an upper spray mechanism 19. The pump has another outlet connected to a lower spray mechanism 20 by a conduit or pipe 21. The pump is selectively operated to withdraw washing fluid from the sump and discharge it through conduits 18,21 to the spray mechanisms 19,20. The fluid is discharged from the spray mechanisms 19,20 and impinges on the articles in the racks 14,15 to wash and rinse the items. The illustrative pump 17 has another outlet connected to a discharge pipe 22 that is connected to a suitable drain. The pump is selectively operated to withdraw fluid from the sump 13 and discharge it to drain through the pipe 22. The pump mechanism or arrangement 17 can take any of several forms. For example it can be a single motor and impeller that discharges the fluid to conduits 18,21 when the motor is energized to rotate in one direction and to discharge fluid to the drain pipe 22 when the motor is energized to rotate in the other direction. On the other hand the pump mechanism 17 can have one motor and two impellers, with one impeller effective to circulate fluid through the spray mechanisms 19,20 and the other impeller effective to discharge fluid to drain through pipe 22. Also the pump mechanism 17 can have two separate motor/pump units. All such approaches are well known in the art.

In the illustrative embodiment the turbidity sensing mechanism will generate a frequency signal representative of clean water at the beginning of a washing sequence or operating cycle. This requires that the pump mechanism 17 drain or exhaust substantially all the fluid from the machine at the end of the prior operating cycle. U.S. Pat. No. 5,320,120, entitled Dishwasher With Dual Pumps, by Hoffmann et al, and incorporated herein by reference, illustrates and describes a dishwasher including a pump arrangement which drains substantially all the fluid from the machine.

Typically a domestic dishwasher provides a washing sequence having a series of operating cycles. Each operating cycle includes a fill step in which fluid (water) is supplied to the machine 10 through inlet mechanism 16; a circulation step in which fluid is withdrawn from the sump 13 by pump 17 and supplied to the spray mechanisms 19,20; and a drain step in which fluid is evacuated from the machine 10 by pump 17 through drain pipe 22. Typically there are a number of pre-rinse cycles in which the water (fluid) supplied to the machine is circulated, without any detergent being added to it, to wash gross soil from the items to be washed. The pre-rinse cycles are followed at least one wash cycle (often referred to as the main wash) in which detergent is added to the water to form an effective washing fluid before it is circulated. The wash cycle is followed by a number of rinse cycles in which water is circulated through the machine to remove the detergent and any residual soil from the items to be washed. For the last rinse cycle, often called the final rinse, a rinse agent is added to the water to help the items to dry without spots. Various of the cycles will be more effective if the fluid has a minimum temperature of at least about 125 degrees F. To that end a heater 23 is included in the sump and is energized to assure the fluid is at the proper temperature.

As explained above, the fluid is drained or exhausted from the dishwasher 10 at the end of each cycle and fresh water is added for the next cycle. Thus, considerable water and heat energy can be saved if the number of cycles is limited to only the number actually needed to properly wash and rinse the items in the racks 14,15. Additional savings can be obtained and the operation improved by tailoring the length of individual cycles to the condition of the items, particularly their condition at the end of the previous cycle.

Co-pending application Ser. No. 08/370,752 (RD 23,989), for example, shows and describes a control system, including a turbidity sensor, for modifying the cycles in accordance with the turbidity of the fluid being used to pre-rinse, wash or rinse the items. As used herein, turbidity is a measure of the suspended and/or soluble soils in the fluid that causes light to be scattered or absorbed. According to one aspect of the present invention there is provided an improved turbidity sensing mechanism for use with such control systems.

Figure 2:
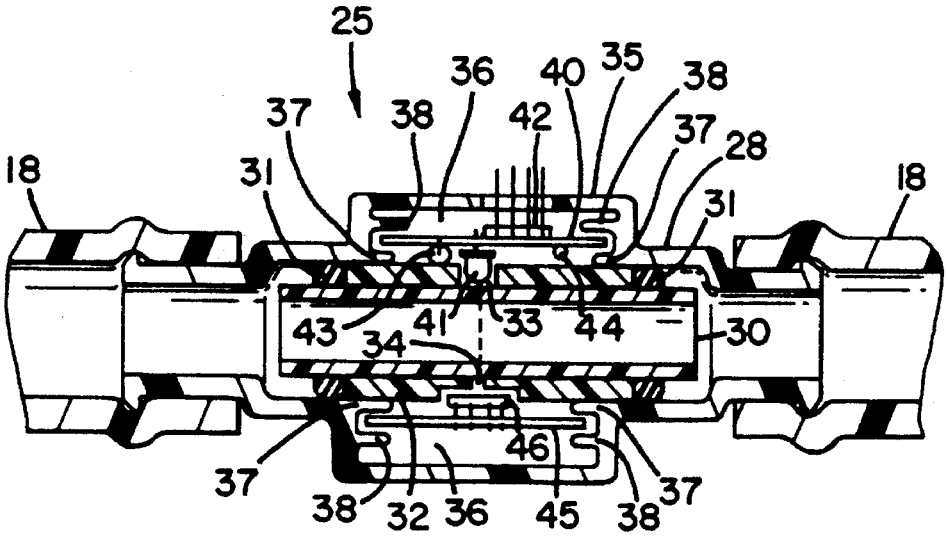
FIG. 2 is a cross section view of the turbidity sensing mechanism incorporated into the machine of FIG. 1.

In accordance with one aspect of the present invention a turbidity sensing mechanism 25 is included in the conduit 18, which connects the pump 17 with the spray mechanism 19. As is indicated in FIG. 1, the sensing mechanism is positioned below the sump 13, generally aligned with the pump 17. Thus, when fluid is in the sump, fluid also is in the sensing mechanism 25. The mechanism 25 is connected to a controller 26 for machine 10 by electrical leads indicated by line 27. Referring now to FIG. 2, the sensing mechanism 25 includes a cylindrical housing 28. The housing is connected in a gap or discontinuity in the conduit 18. Conveniently the housing 28 is formed of two elongated, cylindrical components which are joined together to form the housing. Conveniently the housing components are formed of a molded plastic material, such as acetal for example, and are joined by suitable means, such as being snapped together to form housing 28.

A hollow, elongated cylindrical tube 30 is mounted in housing 25 so as to be in fluid flow relationship with the interior of conduit 18. Conveniently the tube 30 is formed of quartz. An O-ring 31 is positioned between the outer surface of tube 30 and the inner surface of housing 28 near each end of the tube 30 and seals the space between the tube and housing against fluid in the conduit 18. A spacer or carrier 32 fits tightly around the outer surface of the tube 30 and extends between the O-rings 31. The spacer includes a pair of opposed radial openings 33,34 on opposite sides of the tube 30.

The central portion 35 of housing 28 has a larger diameter than the remainder of housing 28 so as to provide a space 36 around tube 30. Short annular ribs 37,38 project axially into the space 36. Conveniently the ribs extend entirely around the housing 28; however, they can be discontinuous and occur only adjacent the openings 33,34. A printed circuit board 40 is mounted between ribs 37,38 adjacent opening 33. A source of electromagnetic radiation, in the form of a light emitting diode (LED) 41 is mounted on the board 40 and is positioned in the opening 33. Conveniently a connector 42, a resistor 43 and a thermistor 44 also are mounted on the board 40.

Light emitted by LED 41 will shine into tube 30 through opening 33. A portion of that light will exit tube 30 through opposite opening 34. In order to exit the tube the light must be propagated through the fluid in the tube. Thus the portion of the light exiting the tube will depend upon the turbidity of the fluid in the tube. The thermistor is positioned so as to sense the temperature in the space 36 and that temperature is dependent upon the temperature of the fluid in the tube. Thus the temperature sensed by thermistor 44 is representative of the temperature of the fluid.

A second printed circuit board 45 is mounted on ribs 37,38 and aligned with the opening 34. An electromagnetic energy sensor 46 is mounted on board 45 in alignment with opening 34 so that the electromagnetic energy (light) exiting tube 30 will impinge upon the sensor. The sensor 46 is a light-to-frequency converter; that is the output signal of the sensor 46 is dependent on the light impinging on the sensor. Conveniently it may be a TSL230 converter sold by Texas Instruments. The sensor is electrically connected to the remainder of the electric components and, more particularly, to the connector 42.

Other mounting arrangements of the various electrical components are contemplated. For example, the bulb of LED 41 can be mounted in the opening 33 in the carrier 32; while the connector 42, the resistor 43 and thermistor 44 are mounted on the circuit board 45. With this arrangement only one circuit board is needed.

Figure 3:
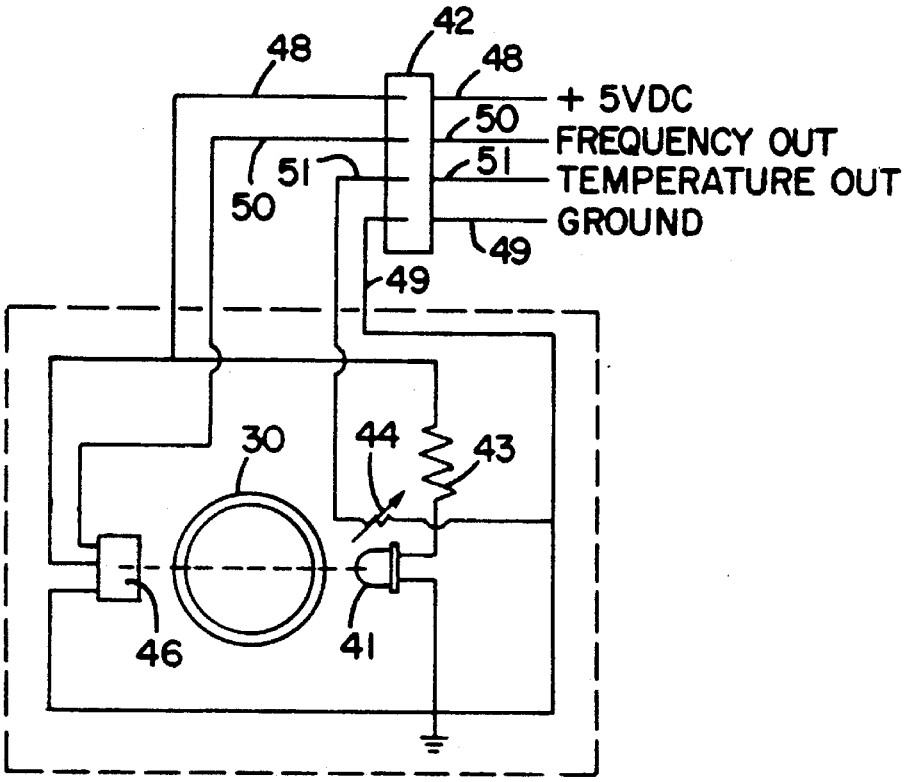
FIG. 3 is a schematic circuit diagram of the sensor incorporated into the sensing mechanism of FIG. 2.

Referring now to FIG. 3, 5 volt DC power is supplied to the components through lead 48 and a ground is provided through lead 49. The LED is connected between the power input 48 and ground 49 in series with resistor 43. The sensor 46 is connected between the power lead 48 and the ground lead 49. The frequency signals generated by the sensor 46 are fed to the controller 26 through a lead 50. The temperature representative analog output signals from the thermistor 44 are fed to the controller 26 through a lead 51.

When energized the LED 41 emits light, a portion of which impinges on sensor 46, depending on the turbidity of the fluid in tube 30. The sensor in turn generates a frequency signal which is dependent on the turbidity of the fluid. When the LED is energized the signals from the sensor are accumulated over a predetermined period of time (measurement interval) to provide a frequency signal value or count that is representative of the turbidity of the fluid then in the tube 30. The digital nature of the sensor output simplifies the control functions and eliminates certain problems of sensitivity of other sensors, which provide either a current or voltage signal.

In the illustrative embodiment the sensing mechanism is operated when the fluid in the tube 30 is quiescent so that the bubbles generated during operation of the machine have dissipated. The fluid in the tube will be quiescent, or still, during a pause between a fill step and the following circulation step and will be still during a pause between a circulation step and the following drain step. As previously explained, the pump mechanism 17 substantially empties the machine of fluid during each drain step of operation. Therefore, a turbidity measurement taken during the pause immediately after the initial fill step of a washing sequence will provide a signal having a value representative of the turbidity of the "clean" water being supplied to the machine. A turbidity measurement taken during the pause immediately following any circulation step will provide a signal having a value representative of the turbidity of the fluid at the end of that circulation operation. The controller 26 uses the initial or clean water signal as a benchmark or basis to determine the turbidity of the fluid at the end of other steps and bases subsequent operation cycles on the signal representing the turbidity of the fluid at the end of a preceding circulation step. As will be understood, the control of an operating cycle may take one or more of several forms. For example the controller may determine whether to execute an additional pre-rinse cycle or proceed to the wash cycle; it may determine whether to invoke another rinse cycle or proceed to the final rinse cycle. On the other hand the controller may determine how long the machine will circulate fluid during the subsequent cycle.

The controller 26 provides a calibration operation of the sensor 46 during the initial operation of the sensing mechanism of each washing sequence. That is, when the sensing mechanism determines the turbidity of the clean water being supplied to the machine. This compensates for variability between sensing mechanisms due to component differences, aging of components and variability in the turbidity of a household water supply. The frequency output range of a TSL230 sensor is between 50 Hz and 150 KHz. It has been determined that the sensing mechanism and controller will operate efficiently when the "clean water" turbidity frequency signal value (count) is between about 30,000 and about 50,000. In the exemplification control the clean water signal value range has been empirically set between 32,512 and 49,152. The particular numbers result from the hexadecimal number system normally utilized in micro processors.

During the calibration operation at the end of the first fill of each washing sequence the LED is energized and the frequency count from the sensor 46 is measured over a one second interval. If the count is too high (above 49,152) the measurement period is decreased by two tenths of a second and the count is re-measured. This is repeated until the measured count is within the predetermined range. At that time the last signal value (count) and the measurement interval are stored. The stored count is used as the clean water turbidity signal value and each subsequent turbidity measurement during that washing sequence is taken over a period of time (measurement interval) of the same length. A similar process is followed if the initial count is less than 32,512. That is the measurement interval is increased in two tenths of a second increments until the count is within the desired range and then the final count and measurement interval are stored. The exemplification system includes cut off measurement intervals of 0.4 and 3 seconds. If the count is not within the designed range when one of the cut off intervals is reached the controller provides an error signal.

Figure 4:
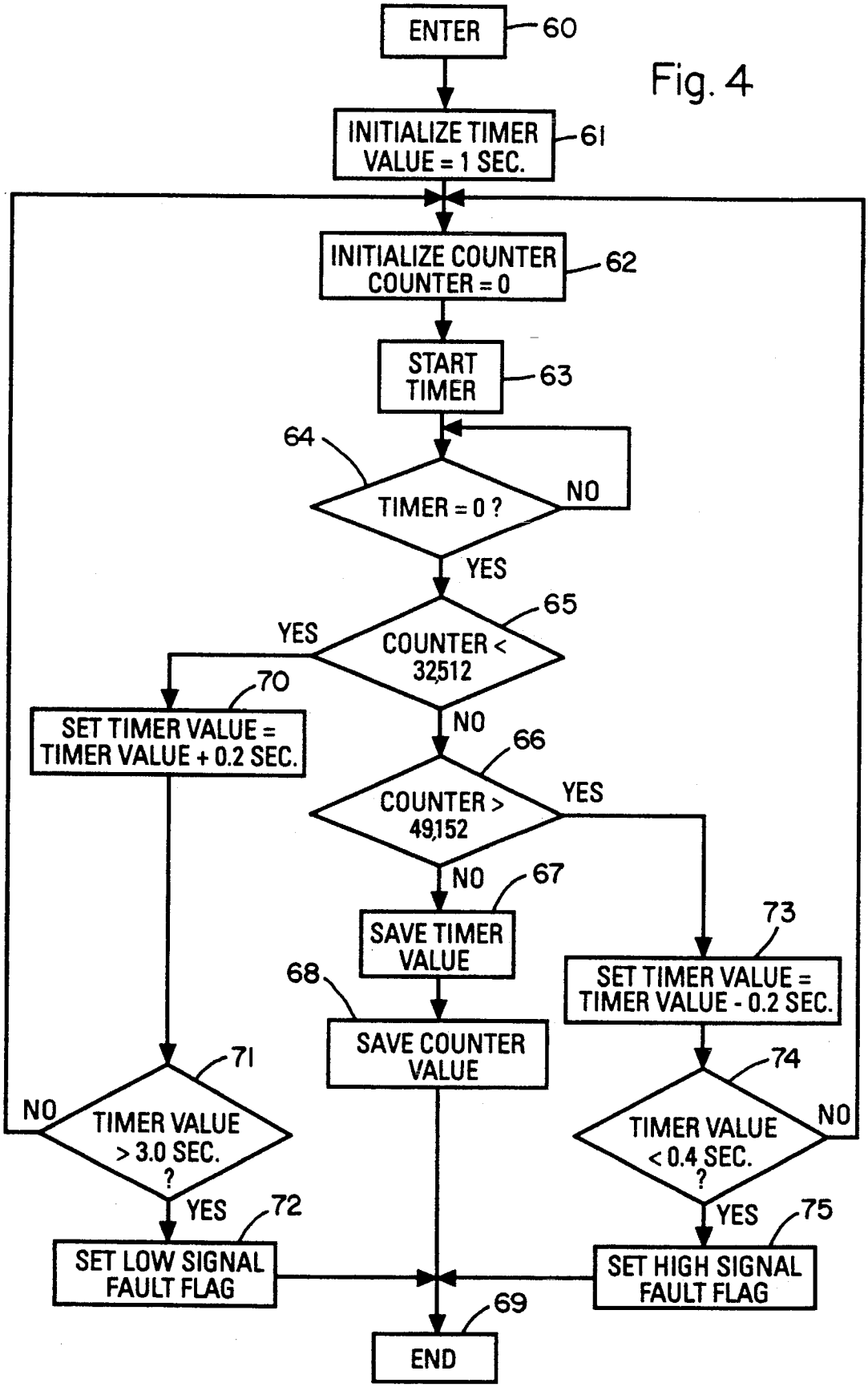
FIG. 4 is a simplified flow chart illustrating the calibration of the sensing mechanism of FIG. 2.

FIG. 4 shows a simplified flow chart for the calibration operation of the sensing system by the controller. The program is entered at block 60 and the timer value (measurement interval) is set to one second at 61. The counter for the sensor frequency signals is set at zero at 62 and the timer is started at 63. At 64 the system is operated until the timer equals zero. Then, at 65 it is determined if the count is less than 32,512. Assuming it is not, then at 66 it is determined whether the count is more than 49,152. Assuming it is not, the value of the timer setting is saved at 67 and the value of the counter is saved at 68 and the routine is exited at 69.

Returning to decision block 65, if the count is less than 32,512, the program branches to block 70 and the timer is set to two tenths of a second longer than the prior timer setting. At block 71 it is determined if the timer setting is longer than three seconds. Assuming it is not, the program returns to block 62 and the sensing mechanism is operated for the just set period of time. Then the program again tests the count as previously described. The time of operation is repeatedly increased until the count falls within the predetermined range and then the time and count values are stored. If the count does not fall within the range when the set time becomes greater than three seconds, the program branches from block 71 to block 72 and sets a low signal flag.

If at block 66 it is determined that the count is larger than 49,152 the program branches to block 73 where the timer setting is decreased by two tenths of a second from the prior setting and then to block 74 where it is determined that the new setting is not less than 0.4 second. The program then returns to block 62 and another sensing operation is carried out. Normally the count will come within the predetermined range and the program will end as previously described. However, if the time set becomes less than 0.4 second without the count becoming acceptable a high signal fault flag is set at block 75.

While specific embodiments of the present invention have been described herein, it is realized that modifications and changes will occur to those skilled in the art to which the invention pertains. It is therefore to be understood that the appended claims are intended to cover all such modifications and changes as fall within the true spirit and scope of the invention.

What is claimed is:

1. A dishwasher comprising:

a wash chamber for receiving fluid and articles to be washed in the fluid;

a spray mechanism for spraying fluid into said chamber to remove soil from articles therein;

a pump connected to said chamber, a conduit connecting said pump to said spray mechanism; said pump being selectively operable to withdraw fluid from said chamber and to supply the fluid to said spray mechanism through said conduit;

a turbidity sensing mechanism including a transparent tube in fluid flow relationship with said conduit between said pump and said spray mechanism; a source of electromagnetic radiation directed into the fluid in said tube; a sensor detecting electromagnetic radiation propagated through the fluid in said tube and providing a frequency signal representative of the turbidity of the fluid in said tube;

said turbidity sensing mechanism includes an elongated housing connected in said conduit, said transparent tube being mounted within said housing in fluid flow relationship with said conduit;

said housing defining a cavity therein around said tube;

said source of electromagnetic radiation being mounted in said cavity adjacent said tube and said sensor being mounted in said cavity adjacent said tube substantially opposite said source.

2. A dishwasher as set forth in claim 1, wherein: said turbidity sensing mechanism includes a thermistor mounted to sense a temperature dependent on the temperature of the fluid in said tube.

3. A dishwasher as set forth in claim 2, wherein:

said tube is an elongated hollow cylinder, a hollow cylindrical carrier fits closely about said tube, said carrier including a pair of opposed, generally radial openings therethrough; one of said openings guiding electromagnetic radiation from said source to said tube and the other of said openings exposing said sensor to electromagnetic radiation propagated through said tube.

4. A dishwasher as set forth in claim 3, further including:

a pair of spaced apart seals closely mounted about said tube and engaging said housing to prevent fluid from entering said cavity around said tube; and wherein said carrier positions said seals longitudinally of said tube.

5. A dishwasher as set forth in claim 1 wherein:

said housing includes radially spaced apart fingers projecting longitudinally into said cavity;

said fingers serving as mounts for said source and said sensor.

6. A dishwasher as set forth in claim 5, wherein:

said source is mounted on a first circuit board, said first circuit board being mounted on predetermined ones of said fingers on one side of said tube; and said sensor is mounted on a second circuit board, said second circuit board being mounted on predetermined ones of said fingers on the opposite side of said tube.

7. A dishwasher as set forth in claim 6, further including: a thermistor mounted on one of said circuit boards and exposed to the atmosphere in said cavity.

8. A dishwasher as set forth in claim 1, wherein:

a carrier is mounted around said tube within said cavity and defines a pair of holes therein on opposite sides of said tube;

said source is mounted in one of said holes in said carrier;

said housing includes radially spaced apart fingers projecting longitudinally into said cavity; and said sensor is mounted on a circuit board mounted on said fingers with said sensor aligned with the other of said holes in said carrier.

9. A dishwasher as set forth in claim 8, further including: a thermistor mounted on said circuit board and exposed to the atmosphere in said cavity.

10. A dishwasher comprising:

a wash chamber for receiving fluid and articles to be washed in the fluid;

a spray mechanism for spraying fluid into said chamber to remove soil from articles therein;

a pump connected to said chamber, a conduit connecting said pump to said spray mechanism; said pump being selectively operable to withdraw fluid from said chamber and to supply the fluid to said spray mechanism through said conduit;

a turbidity sensing mechanism including a transparent tube in fluid flow relationship with said conduit between said pump and said spray mechanism; a source of electromagnetic radiation directed into the fluid in said tube; a sensor detecting electromagnetic radiation propagated through the fluid in said tube and providing a frequency signal representative of the turbidity of the fluid in said tube;

a water inlet mechanism for supplying fluid to said chamber;

drain mechanism for evacuating fluid from said chamber;

a controller responsive to frequency signals from said sensor and effective to cause said dishwasher to execute a washing sequence of a series of operations, each operation including a step of supplying fluid to said chamber, a step of circulating the fluid and a step of evacuating the fluid from said chamber;

said controller being operative to calibrate said sensor by repeatedly sampling the frequency signals from said sensor, over a measurement interval prior to the circulating step of the initial operation of a washing sequence, determining whether the value of that frequency signal is within a predetermined band of frequency signal values; and repeatedly varying the measurement interval over which the frequency signal is measured until the frequency signal value is within the predetermined band of frequency signal values; and storing the measurement interval over which the frequency signal value that is within the predetermined band of frequency signal values is measured for use as the measurement interval when subsequently sampling the frequency signal from said sensor to obtain liquid turbidity measurements during the balance of the washing sequence.

* * * * *